US012805589B2

(12) United States Patent
Bi et al.

(10) Patent No.: US 12,805,589 B2
(45) Date of Patent: Nov. 24, 2026

(54) ASEPTIC FOLDING FOR CLEANROOM CLOTHING

(71) Applicant: Ansell Limited, Richmond (AU)

(72) Inventors: Jiarui Bi, Mianyang City (CN); Akun Xu, Xiamen City (CN); Zhanglan Fu, Xiamen City (CN); Lingzhou Shen, Xiamen City (CN)

(73) Assignee: Ansell Limited, Victoria (AU)

( * ) Notice: Subject to any disclaimer, the term of this patent is extended or adjusted under 35 U.S.C. 154(b) by 20 days.

(21) Appl. No.: 19/104,292

(22) PCT Filed: Aug. 16, 2023

(86) PCT No.: PCT/AU2023/050772

§ 371 (c)(1),
(2) Date: Feb. 17, 2025

(87) PCT Pub. No.: WO2024/036368

PCT Pub. Date: Feb. 22, 2024

(65) Prior Publication Data

US 2026/0053222 A1 Feb. 26, 2026

Related U.S. Application Data

(60) Provisional application No. 63/398,768, filed on Aug. 17, 2022.

(51) Int. Cl.
*A41H 43/02* (2006.01)
*A41D 13/02* (2006.01)

(52) U.S. Cl.
CPC ..... *A41H 43/0257* (2013.01); *A41D 13/02* (2013.01); *A41D 2400/422* (2013.01)

(58) Field of Classification Search
CPC ..... A41D 13/1153; A41D 13/1218; A41D 13/129; A41H 43/0257
See application file for complete search history.

(56) References Cited

U.S. PATENT DOCUMENTS 4,942,987 A 7/1990 Stakhouse
11,627,767 B2 * 4/2023 Mithani ..... A41D 13/1218 2/456

(Continued)

FOREIGN PATENT DOCUMENTS

EP 2 992 769 B1 11/2019
EP 3386328 B1 * 3/2021 ..... D06F 89/02

(Continued)

OTHER PUBLICATIONS

"Army Packing Hack: How to Ranger Roll Long Sleeve Shirts—Basic Training APFU PT Uniform", https://www.youtube.com/watch?v=pZL5TNcRiKo (Year: 2013).*

(Continued)

*Primary Examiner* — Shaun R Hurley
(74) *Attorney, Agent, or Firm* — Moser Taboada

(57) ABSTRACT

A method is provided for aseptically folding a garment having a main body and a garment sleeve having an inner side and an outer side. The method includes, with the garment in an outside-out configuration, rolling a first portion of a garment sleeve, and tucking the rolled first portion into an unrolled second portion of the garment sleeve. Also, the method includes, after tucking, turning a portion of the main body inside-out.

18 Claims, 9 Drawing Sheets

(56) References Cited

U.S. PATENT DOCUMENTS

| | | | | |
|---|---|---|---|---|
| 2004/0261161 | A1 | 12/2004 | Roy | |
| 2009/0120975 | A1* | 5/2009 | Schoepe | A47G 25/905 223/111 |
| 2015/0135398 | A1* | 5/2015 | Czajka | A41D 13/12 2/114 |
| 2020/0214489 | A1* | 7/2020 | Merriam | A47G 25/907 |
| 2021/0076760 | A1 | 3/2021 | Wang et al. | |
| 2021/0169158 | A1 | 6/2021 | Mithani et al. | |

FOREIGN PATENT DOCUMENTS

| | | | | |
|---|---|---|---|---|
| WO | WO 2011/014354 | A1 | 2/2011 | |
| WO | WO-2017124205 | A1 * | 7/2017 | A41D 13/129 |
| WO | WO-2021113575 | A1 * | 6/2021 | A41D 13/1218 |

OTHER PUBLICATIONS

International Search Report for PCT application PCT/AU2023/050772 dated Dec. 4, 2023.

* cited by examiner

ASEPTIC FOLDING FOR CLEANROOM CLOTHING

BACKGROUND

Field of the Invention

Embodiments of the disclosure generally relate to methods and apparatus for aseptic packaging, and more particularly, to aseptic packaging of garments.

Description of the Related Art

Protective coveralls are one type of limited-use or disposable protective garments that can provide barrier properties. Coveralls have many applications where isolation of a wearer is desirable. Such protective apparel keeps clothing clean and keeps dirt and other residue off of the wearer's skin. For a variety of reasons, it is undesirable for hazardous liquids and/or pathogens that may be carried by liquids to pass through protective apparel. It is also highly desirable to use protective apparel to isolate persons from dusts, powders, and other particulates that may be present in a workplace or accident site. Conversely, in cleanroom, critical manufacturing, and surgical environments, the protective apparel protects the environment from dust and debris that may otherwise be carried into the environment by the wearer.

Due to the critical, sterile character of cleanroom environments, stringent protocols regarding apparel and apparel donning are followed such that no contaminants from the worker are not accidentally transferred to the product or patient that the environment is structured to protect. To prevent such contamination, workers don coveralls and are trained to carefully don such garments without touching exterior surfaces of the garment while also being careful that the garment does not touch the floor. If the user touches the exterior surfaces or the garment touches the floor, the user must obtain another, uncontaminated, garment to don. Therefore, the inventors describe herein improved methods and apparatus for aseptically folding garments, such as cleanroom coveralls.

SUMMARY

According to some embodiments, a method is described for aseptically folding a garment having a main body and a garment sleeve having an inner side and an outer side, the method comprising: with the garment in an outside-out configuration: rolling a first portion of a garment sleeve; tucking the rolled first portion into an unrolled second portion of the garment sleeve; after tucking, placing or folding the tucked sleeve on the main body and turning a portion of the main body inside-out.

According to some embodiments, a method is described for donning an aseptically folded garment having a main body and a sleeve having an inner side and an outer side, the sleeve having a rolled first portion tucked into an unrolled second portion, where a portion of the main body is inside out, and the main body and the sleeve are folded, the method comprising: while contacting only the inner side of the garment, inserting a limb into the unrolled second portion of the sleeve; and pushing on the rolled first portion of the sleeve to unroll the first portion of the sleeve thereby allowing the limb to move through the first portion of the sleeve.

According to some embodiments, an aseptically folded garment is described comprising: a main body; and a sleeve extending from the main body, wherein the sleeve has a first portion and a second portion, wherein the first portion is rolled and the second portion is unrolled and the rolled first portion is tucked into the unrolled second portion.

Various advantages, aspects and novel and inventive features of the present disclosure, as well as details of illustrative embodiments thereof, will be more fully understood from the following description and drawings. The foregoing summary is not intended, and should not be contemplated, to describe each embodiment or every implementation of the embodiments. Other and further embodiments of the present disclosure are described below.

DETAILED DESCRIPTION

Before describing embodiments of the present invention in detail, the terminology used herein is for the purpose of describing particular embodiments only, and is not intended to be limiting. The invention should not necessarily be limited to specific compositions, materials, designs or equipment, as such may vary. All technical and scientific terms used herein have the usual meaning that is conventionally understood by persons skilled in the art to which embodiments of this invention pertain, unless context defines otherwise. Also, as used in this specification and the appended claims, the singular forms "a," "an," and "the" may include plural referents unless the context clearly dictates otherwise.

Embodiments of the present disclosure may advantageously be used to prevent accidental transfer of contaminants from a worker to a product or patient. Embodiments of the present disclosure may advantageously be used to enhance cleanliness and productivity of cleanroom work environments.

Figure 1:
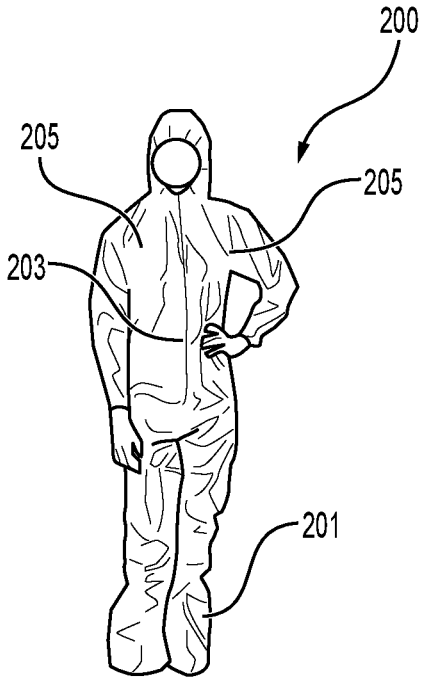
FIG. 1 depicts an exemplary coverall with a hood and booties in accordance with an embodiment of the disclosure.
Figure 2:
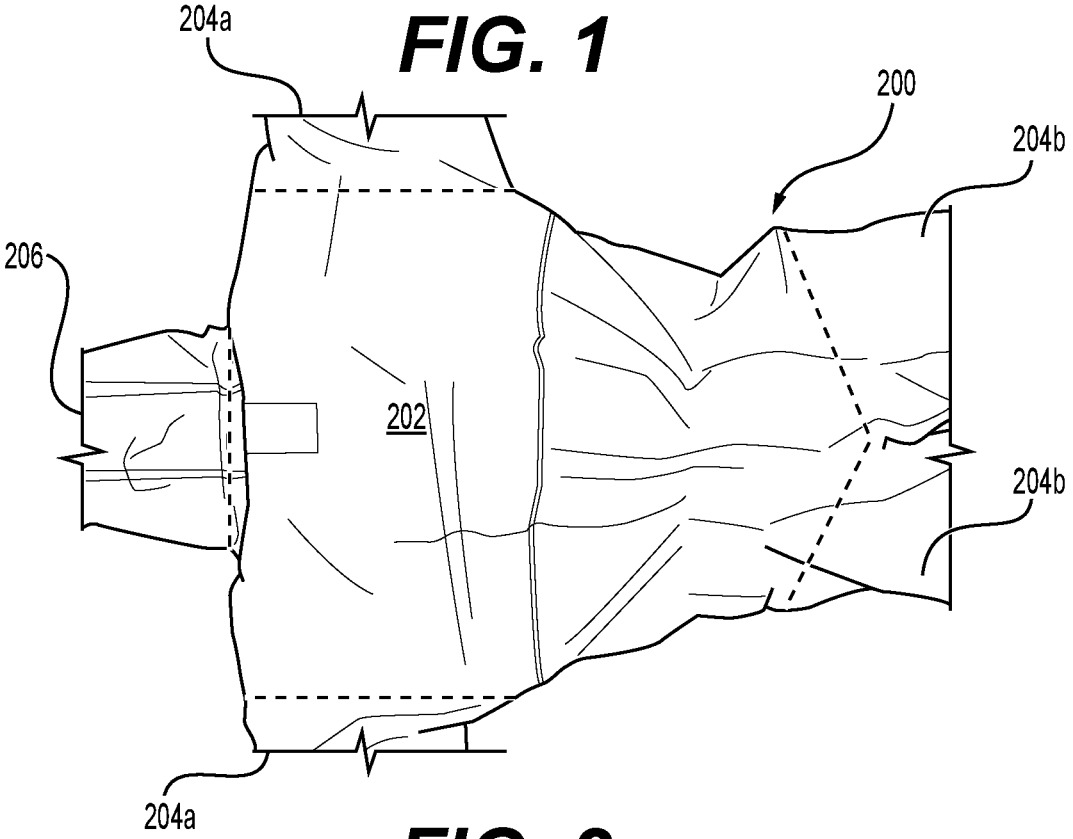
FIG. 2 depicts a garment in a flattened configuration with a back facing upward in accordance with an embodiment of the disclosure.

FIGS. 1 and 2 show an aseptic garment 200, embodied as a cleanroom coverall. The garment 200 may include a main body 202 configured to cover a torso and sleeves 204*a*, 204*b* configured to cover limbs (e.g., arms and legs). Sleeves may include arm sleeves 204*a* and leg sleeves 204*b*. The garment 200 has an inner side and an outer side (the outer side is shown in FIG. 2). In some embodiments, and as shown in FIG. 2, the garment 200 may have a hood 206 configured to cover a head. Also, in some embodiments, the garment 200 may optionally include booties 201 shown in FIG. 1 (but not shown in the remaining figures), to cover feet. Also, the garment 200 may include a zipper 203 to join portions 205 covering the chest. The garment 200 may be configured to cover over substantially all of the clothing of a user. To enable aseptic packaging and donning of the garment 200, an aseptic folding method in accordance with the instant disclosure will now be described with reference to FIGS. 2-11.

In some embodiments, and as shown in FIG. 2, with the garment 200 outside out, the garment 200 is laid flat (e.g., on a table or other support surface) with a back 208 of the garment 200 facing upwards (e.g., away from the table or other support surface) with the hood 206, the arm sleeves 204*a*, and the leg sleeves 204*b* fully extended from the main body 202. One or more of the sleeves 204*a*, 204*b* may be shortened to facilitate compactly folding the garment 200. Each sleeve 204*a*, 204*b* may have a first portion (e.g., 302) having a first length L1 and a second portion (e.g., 304) having a second length L2. Each sleeve 204*a*, 204*b* may have a proximal end 502 at the main body 202 and a distal end 504 spaced from the proximal end so that the first portion (e.g., 302) is disposed distally (with respect to the main body 202) of the second portion (e.g., 304).

Figure 3:
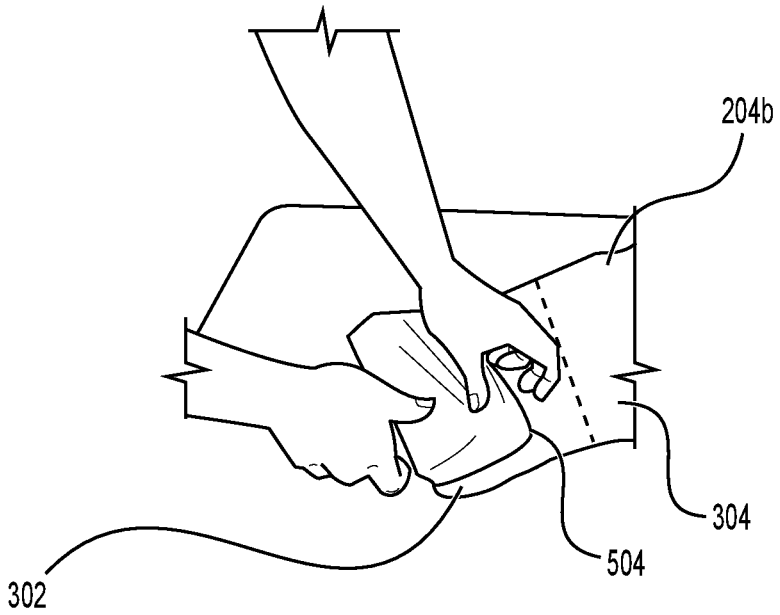
FIG. 3 depicts rolling one leg sleeve of the garment of FIG. 2 with a first portion rolled.
Figure 4:
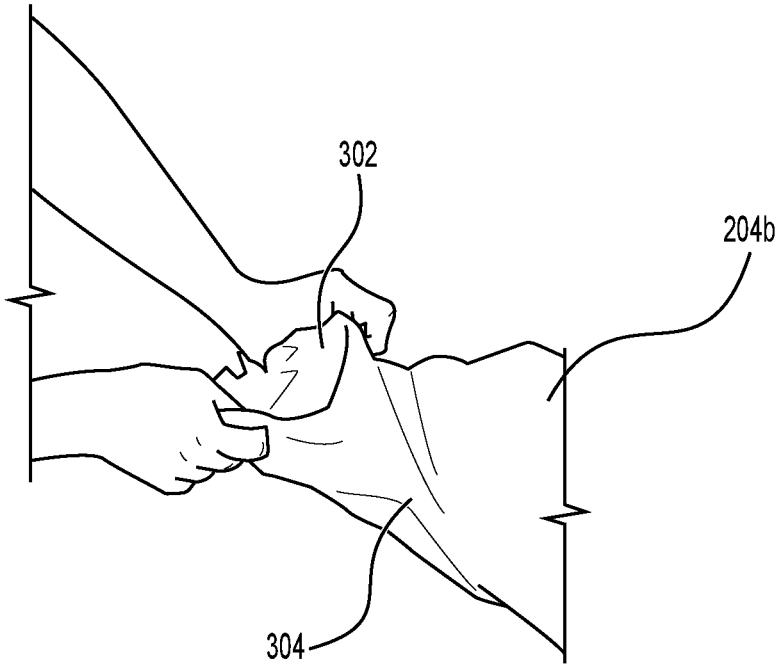
FIG. 4 depicts shortening one of the leg sleeves by tucking the rolled first portion of FIG. 3 into a second portion of the leg sleeve shown in FIG. 2.
Figure 5A:
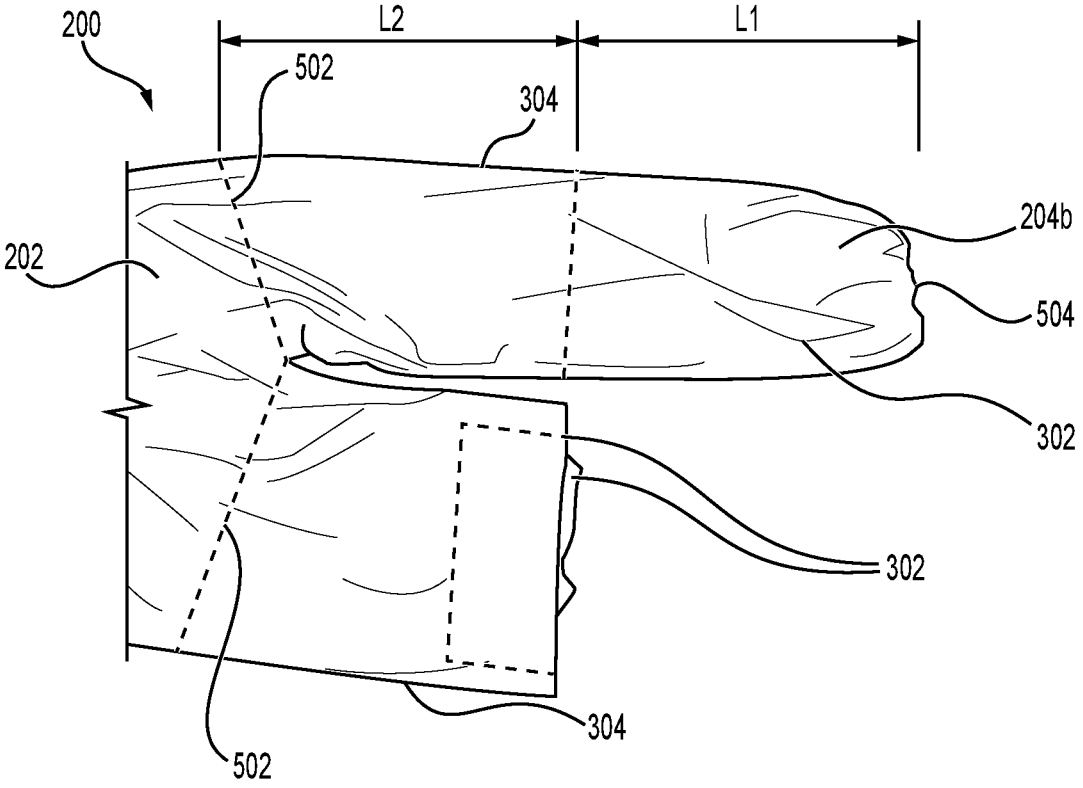
FIG. 5A depicts the leg sleeve of FIG. 4 shortened.
Figure 5B:
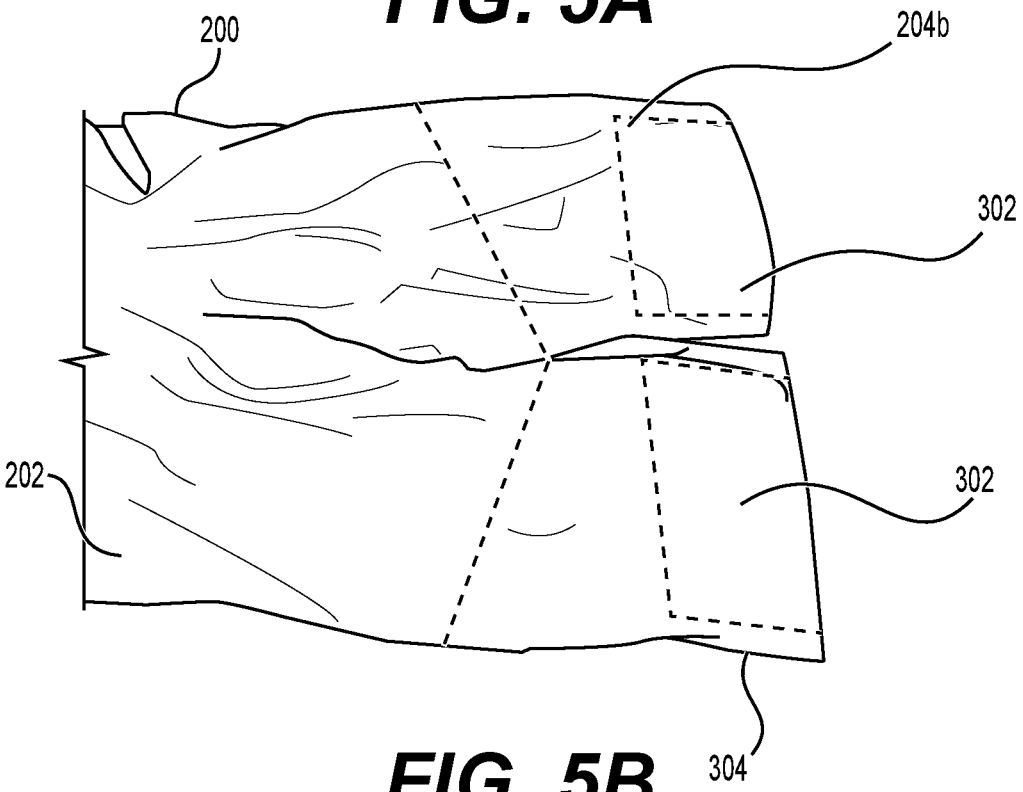
FIG. 5B depicts two leg sleeves shortened.

For example, in some embodiments, and as shown in FIG. 3, a first portion 302 of the leg sleeve 204*b* is rolled towards a second portion 304 and towards the main body 202. When so rolled, the distal end 504 is on an inside of the rolled first portion 302 and, thus, becomes not visible. Also, as shown in FIG. 4, the second portion 304 remains unrolled while the rolled first portion 302 of the sleeve 204*b* is tucked into the second portion 304, thereby shortening the leg sleeve as shown in FIG. 5A. The other leg sleeve 204*b* and/or one or more of the arm sleeves 204*a* may be shortened in the same manner as described above. In some embodiments, at least one sleeve 204*a*, 204*b* may be shortened by rolling and tucking as described above for sleeve 204*b* shown in FIG. 3. In some embodiments, one or both arm sleeves 204*a* may be rolled and tucked as described above. In some embodiments, one or both leg sleeves 204*b* may be rolled and tucked as described above. Two leg sleeves 204*b* are shown shortened in FIG. 5B with the rolled first portion 302 shown with broken lines tucked inside the second portion 304. Thus, when the first portion 302 is rolled and tucked inside the second portion 304, the distal end 504 is not visible.

Figure 6:
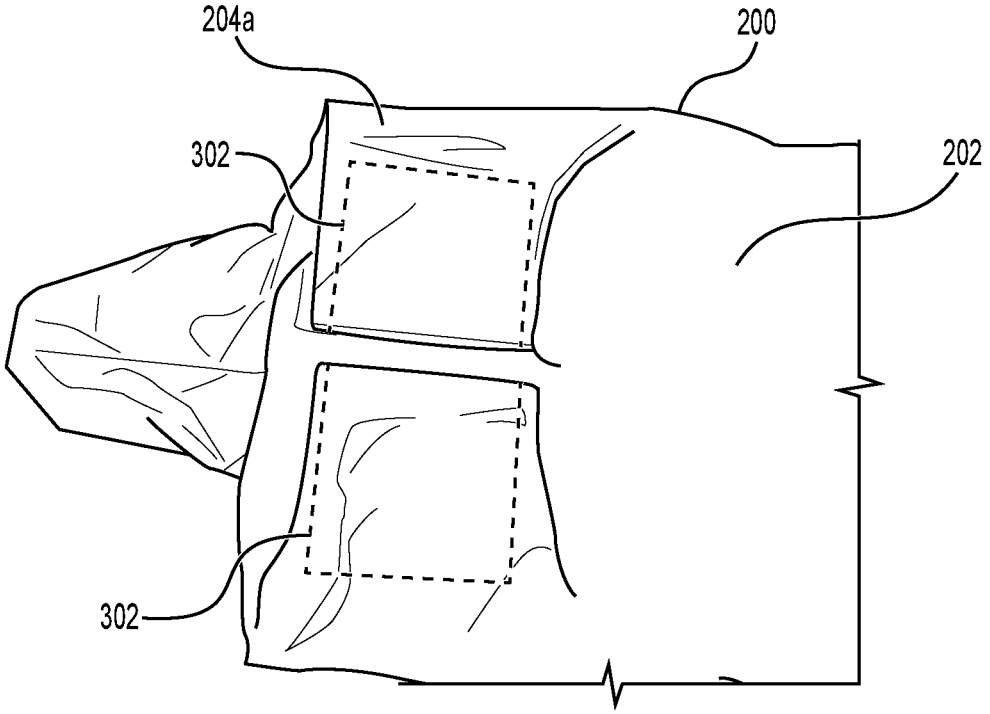
FIG. 6 depicts arm sleeves of the garment shown in FIG. 2 shortened as depicted in FIGS. 3 and 4 and folded in half.
Figure 7:
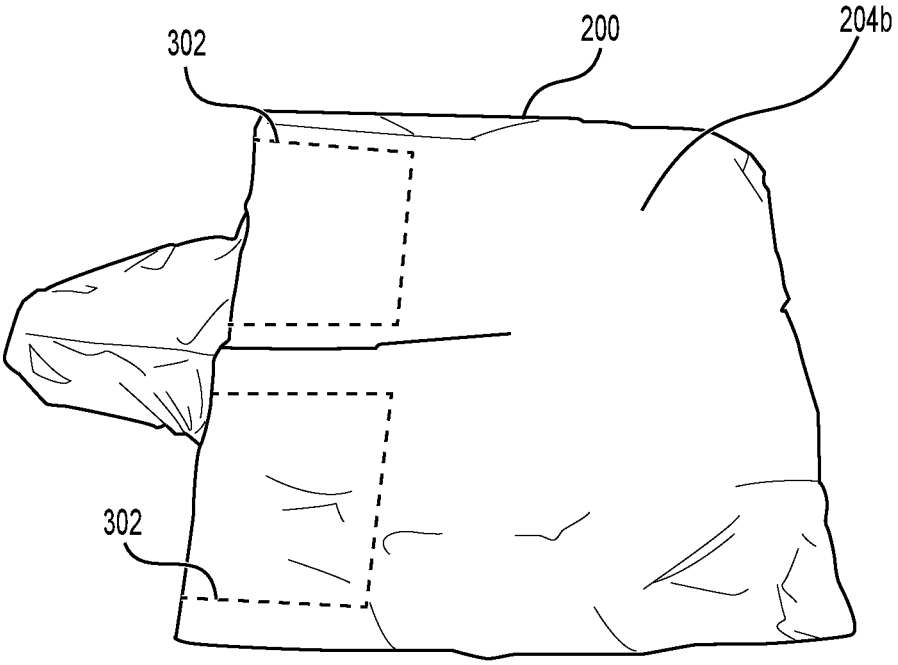
FIG. 7 depicts the garment of FIG. 6 with the leg sleeves folded upward over the folded arm sleeves.
Figure 8:
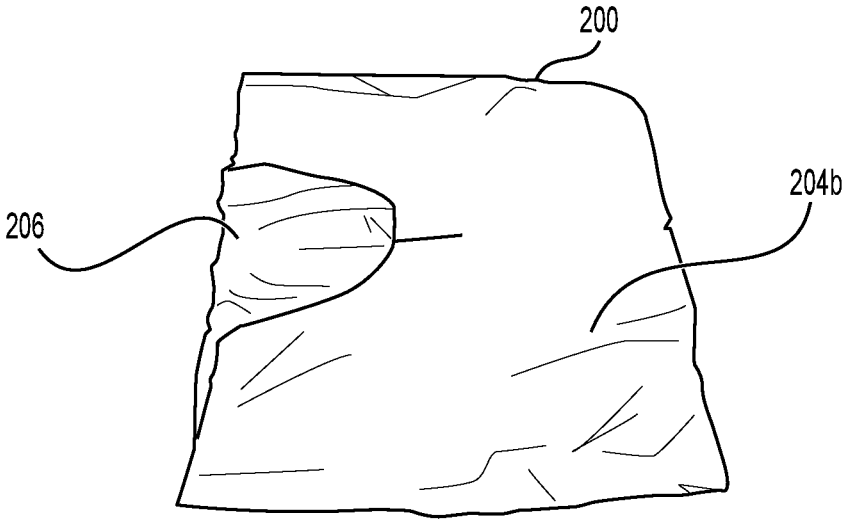
FIG. 8 depicts the garment of FIG. 2 with a hood of the garment folded down over the folded leg sleeves.

In some embodiments, after shortening the sleeves 204*a*, 204*b*, the sleeves may be folded. For example, as shown in FIG. 6, shortened arm sleeves 204*a* of the garment 200 are folded in half, although other proportions are possible. Also, as shown in FIG. 7, the leg sleeves 204*b* may be folded up and over the folded arm sleeves 204*a* to cover the folded arm sleeves 204*a*. If present, the hood 206 may be folded down over the folded leg sleeves 204*a*, as shown in FIG. 8.

Figure 9A:
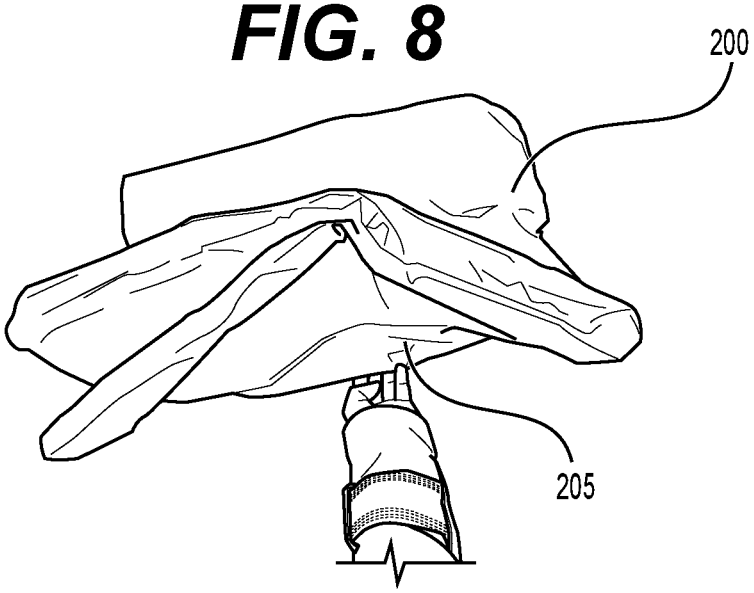
FIGS. 9A-9C show a sequence of turning one side of a flap of the garment inside out.
Figure 9B:
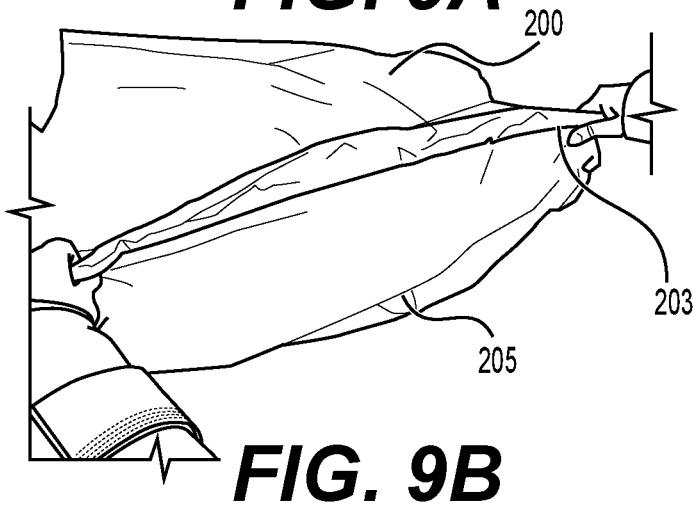
Figure 9C:
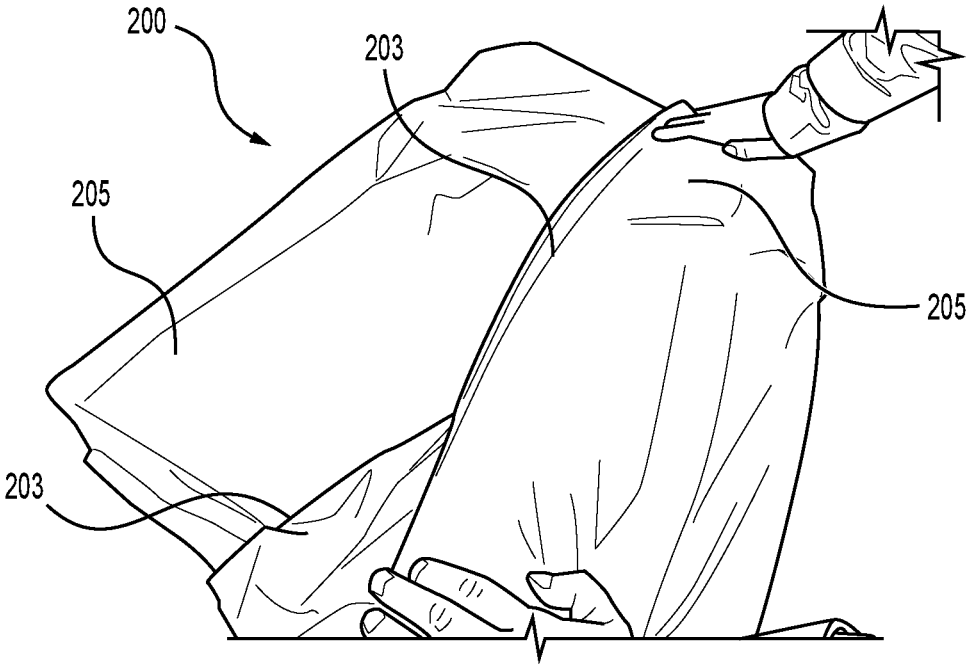

To facilitate aseptic handling and donning of the garment 200, a portion of the garment 200 may be turned inside out before packaging the garment 200 so that when a user removes the folded garment from the packaging, the user can handle the garment by contacting only the inner side of the garment 200, thereby preventing contamination of the outer side of the garment. For example, in some embodiments, and as shown in FIGS. 9A-9C, one portion 205 (on one side of the zipper 203) of the garment 200 is turned inside out and wrapped around the side of the garment 200. Due to folding of the garment 200 into the configuration shown in FIG. 8, the zipper 203 may be on the bottom in FIG. 8. The process in FIGS. 9A-9C can be repeated on the portion 205 on an opposite side of the zipper 203 resulting in the garment being folded as shown in FIG. 9D.

Figure 9D:
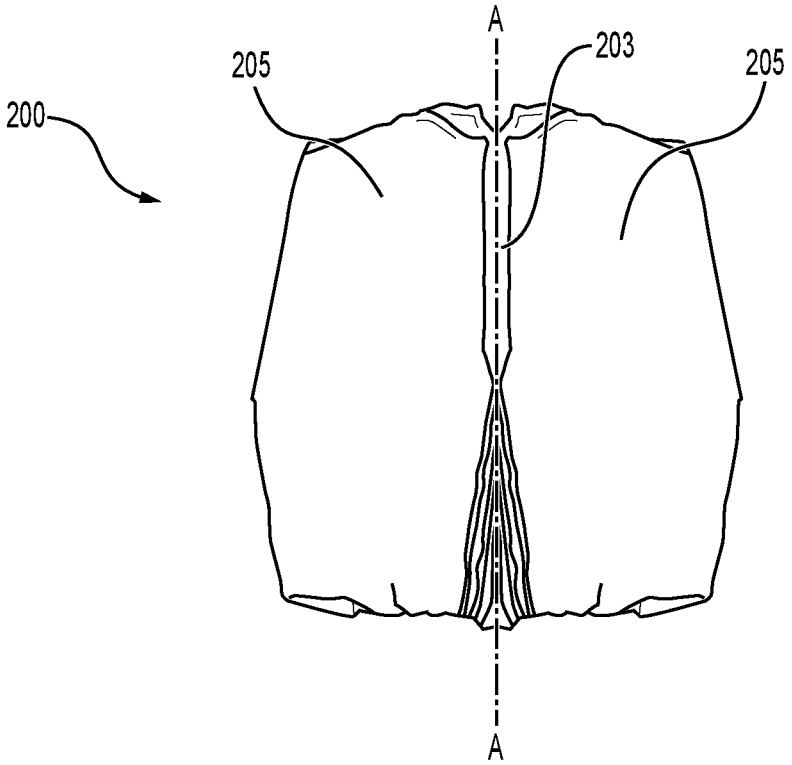
FIG. 9D shows the garment folded after repeating the sequence of FIGS. 9A-9C for another side of the garment.
Figure 9E:
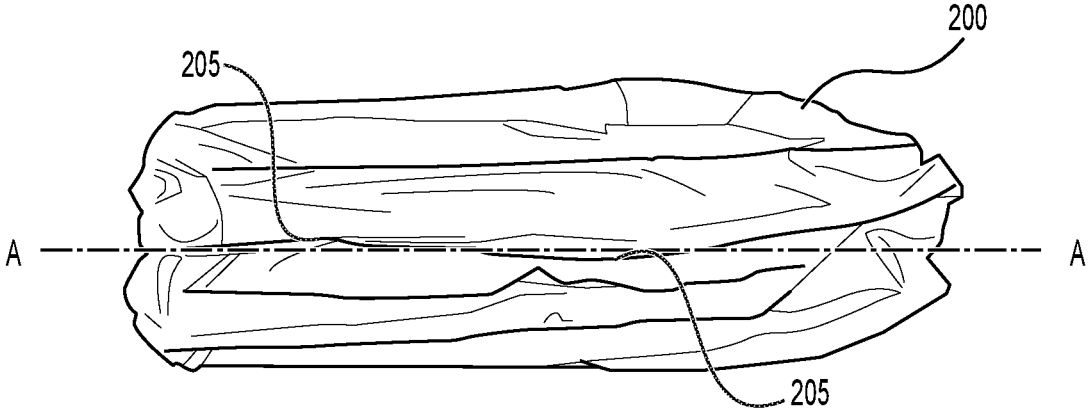
FIG. 9E shows the garment shown in FIG. 9*d* folded across axis A-A in FIG. 9*d*.
Figure 10:
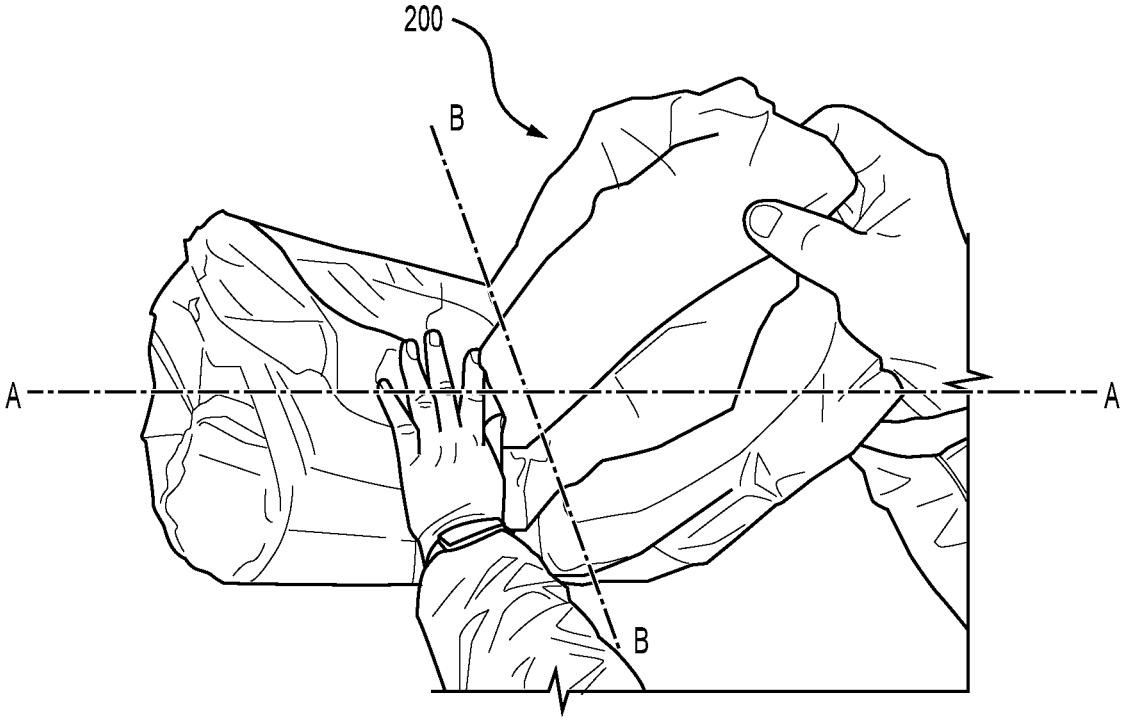
FIG. 10 shows the garment shown in FIG. 9*d* being folded in half across axis B-B in FIG. 10.
Figure 11:
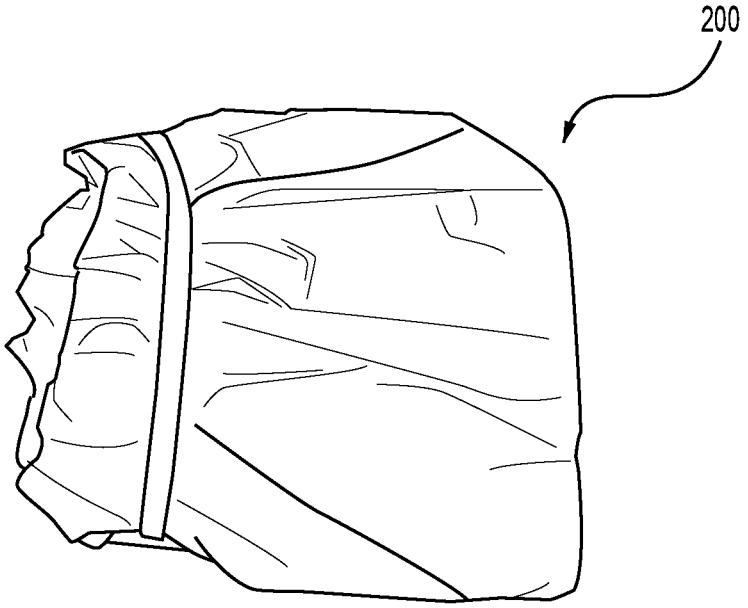
FIG. 11 shows the garment folded in a final configuration ready for packaging.

The garment 200 in FIG. 9D can be made more compact for packaging by making a further fold across axis A-A in FIG. 9D. For example, FIG. 9*e* shows the garment 200 of FIG. 9*d* when the garment folded across axis A-A in FIG. 9*d*, such as by folding the two portions 205 to face one another as shown in FIG. 9*e*. FIG. 10 shows the garment 200 shown in FIG. 9E being folded in half across axis B-B to arrive at a final folded configuration of the aseptically folded garment 200 ready for aseptic packing, such as in a sealed plastic bag (not shown). In some embodiments, the axis B-B may be located at a position along axis A-A other than a midpoint of the garment 200 so that the garment 200 may be folded in other proportions. For example, the axis B-B may be located at approximately ⅓ of the length of the garment from one side (e.g., left side) in FIG. 10. In some embodiments, in the aseptic folded configuration, the distal ends (e.g., distal ends 504) or opening of the sleeves of the garment 200 remain rolled in the first portion 302 and tucked inside the second portion 304 and thus remain not visible.

Garments that are aseptically folded in accordance with this disclosure may be donned aseptically as follows. In some embodiments, a user may grasp the folded garment by the portion(s) 205 of the garment turned inside out while inserting a limb into a corresponding sleeve 204*a*, 204*b* of the garment 200. Specifically, the user may insert their limb into a proximal end (with respect to the main body 202) of a sleeve 204*a*, 204*b* and moving the limb into the second portion 304 of the sleeve so that the limb pushes on the rolled first portion 302 of the sleeve. As the limb is pushed distally, the rolled first portion 302 can unroll allowing the limb to pass completely through the sleeve 204*a*, 204*b* through a distal end of the sleeve 204*a*, 204*b* without contacting the outer side of the garment 200. The user may repeat the foregoing procedure for their other limbs and with the other sleeves of the garment. As a result of the aseptic folding described herein, donning of the folded garment can be accomplished aseptically.

Comparative Examples

Four folded coverall garments were tested by measuring the time for a user to don the garment. Item 1 is was a coverall garment with a hood constructed as described herein and item 2 was a coverall garment with a hood and boots constructed as described herein. Items 1 and 2 were folded in using methods described in accordance with embodiments of the present disclosure.

Items 3 and 4 were folded coverall garments that were folded using methods not in accordance with embodiments of the present disclosure. Item 3 was a folded coverall garment that has a hood and item 4 was a folded coverall garment without a hood. Item 3 was folded as follows: the sleeves and the legs were folded inwards and affixed to the inner portion of the garment using a fastener; and then the garment was inverted inside out. Item 4 was folded as follows: only the legs of the garment were inverted and then the entire garment was reversed out (e.g., inside-out).

TABLE 1

| Item (Folded Coverall) | Donning Time (Seconds) |
|---|---|
| 1 | 60 |
| 2 | 68 |
| 3 | 123 |
| 4 | 98.8 |

During the testing, a user was timed to aseptically (without handling or otherwise touching the exterior of the garment) don each item. As shown in Table 1, above, items 1 and 2 took less time to aseptically don than items 3 and 4.

Figure 12:
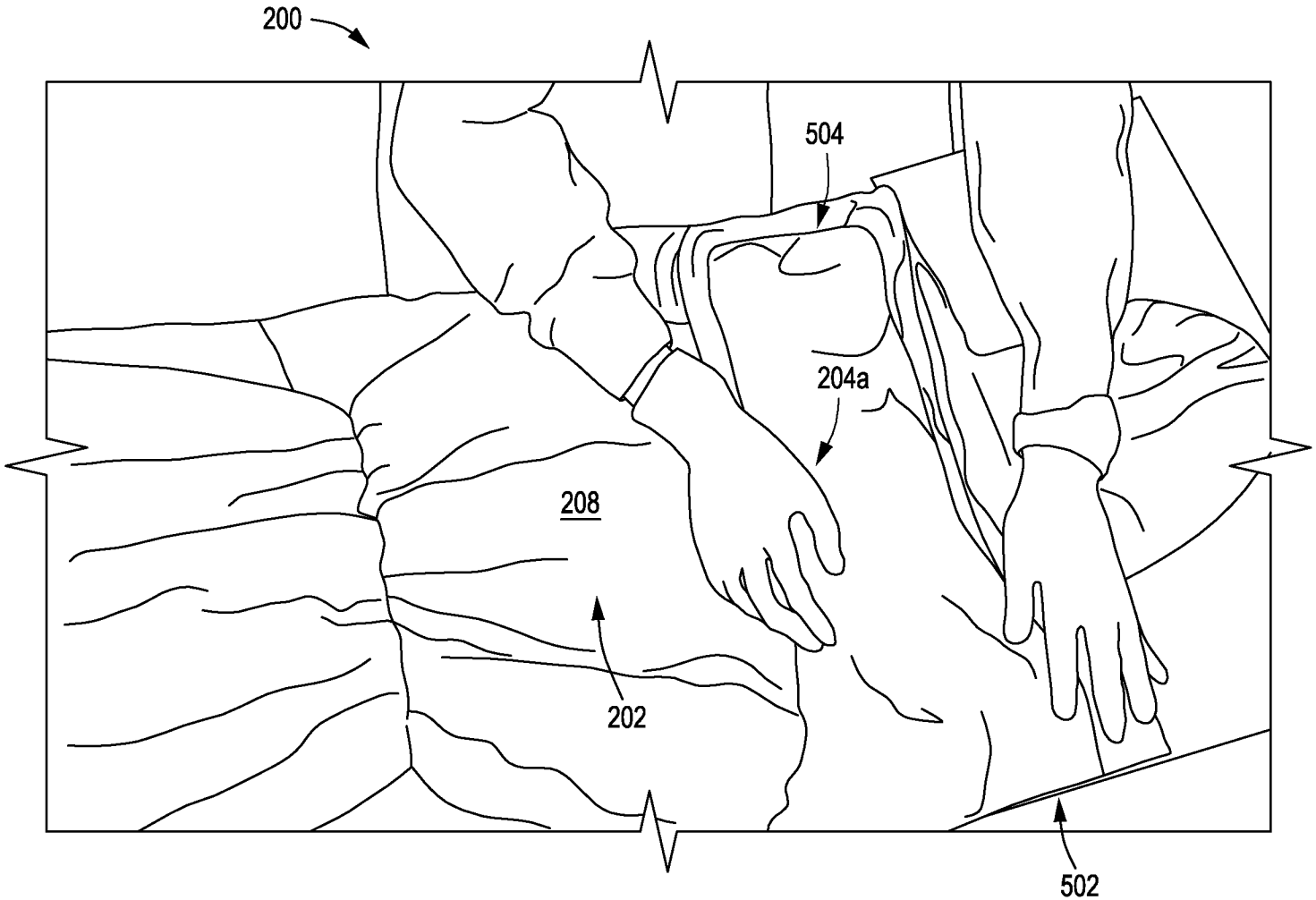
FIG. 12 depicts a garment in a flattened configuration with a back facing upward and a sleeve folded a proximal end of the sleeve over the back in accordance with an embodiment of the disclosure.

FIG. 12 depicts the garment 200 in a flattened configuration with a back 208 of the garment 200 facing upward and a sleeve 204*a* folded at a proximal end 502 of the sleeve 204*a* over the back 208 in accordance with an embodiment of the disclosure. In the embodiment shown in FIG. 12, the sleeve 204*a* is not folded, tucked, or rolled between proximal end 502 and the distal end 504. Also, in the embodiment shown in FIG. 12, the sleeve 204*a* is not foreshortened. Instead, the entire length of the sleeve 204*a* extends over the back 208. In some embodiments, the proximal end 502 of the sleeve 204*a* may extend along a seam of the garment 200 connecting the sleeve 204*a* to the main body 202 of the garment 200. In some embodiments, one or more arm sleeves 204*a* may be folded as shown in FIG. 12. In some embodiments, one or more leg sleeves 204*b* may be folded like the arm sleeves 204*a* shown in FIG. 12.

Although some embodiments have been discussed above, other implementations and applications are also within the scope of the following claims. Although various embodiments herein have been referred to with particularity, it is to be understood that these embodiments are merely illustrative of the principles and applications of the various embodiments. It is therefore to be understood that modifications may be made to the illustrative embodiments and other embodiments may be devised without departing from the spirit and scope of the present disclosure.

Publications and references, including but not limited to patents and patent applications, cited in this specification are herein incorporated by reference in their entireties as if each individual publication or reference were specifically and individually fully set forth herein. Any patent application to which this application claims priority is also incorporated by reference herein in the manner described above for publications and refer.

What is claimed is:

1. A method for aseptically folding a garment having a main body and a garment sleeve having an inner side and an outer side, the method comprising:

with the garment in an outside-out configuration:

rolling a first portion of a garment sleeve;

tucking the rolled first portion into an unrolled second portion of the garment sleeve;

after tucking, turning a portion of the main body inside-out; and folding the garment sleeve before turning the portion of the body inside out.

2. The method of claim 1, wherein the garment sleeve has a proximal end at the main body portion and a distal end spaced from the proximal end, and wherein the first portion is disposed distally of the second portion.

3. The method of claim 2, further comprising, folding the main body portion after turning the portion of main body inside out.

4. The method of claim 1, further comprising repeating the rolling and the tucking for at least one additional garment sleeve of the garment.

5. The method of claim 1, further comprising folding at least one of a hood or a bootie attached to the garment.

6. The method of claim 1, further comprising placing the garment sleeve over the main body before turning the portion of the body inside out.

7. A method for donning an aseptically folded garment having a main body and a sleeve having an inner side and an outer side, the sleeve having a rolled first portion tucked into an unrolled second portion, where a portion of the main body is inside out, and the main body and the sleeve are folded, and wherein the sleeve is folded over the main body, the method comprising:

while contacting only the inner side of the garment, inserting a limb into the unrolled second portion of the sleeve; and pushing on the rolled first portion of the sleeve to unroll the first portion of the sleeve thereby allowing the limb to move through the first portion of the sleeve.

8. The method of claim 7, further comprising unfolding at least one of the main body or the sleeve before inserting the limb.

9. The method of claim 7, wherein the aseptically folded garment includes at least one additional sleeve, and the method further comprises repeating the inserting and the pushing for the at least one additional sleeve of the aseptically folded garment.

10. The method of claim 9, further comprising unfolding at least one of the main body or each sleeve before inserting the limb.

11. An aseptically folded garment comprising:

a main body; and a sleeve extending from the main body, wherein the sleeve has a first portion and a second portion, wherein the first portion is rolled and the second portion is unrolled and the rolled first portion is tucked into the unrolled second portion, wherein the sleeve is folded over the main body.

12. The garment according to claim 11, wherein the sleeve and the main body are folded.

13. The garment according to claim 12, wherein the sleeve has a proximal end at the main body and a distal end spaced from the proximal end and the sleeve is folded at the proximal end.

14. The garment according to claim 12, wherein the main body and the sleeve have an inner side and an outer side, wherein a portion of the main body is in an inside-out configuration.

15. The garment according to claim 11, further comprising at least one of a hood attached to the main body or a bootie attached to the sleeve.

16. The garment according to claim 15, wherein the hood is folded over at least one of the body or the sleeve.

17. The garment according to claim 11, wherein the sleeve is folded over a back of the main body.

18. The garment according to claim 11, wherein the garment includes a plurality of the sleeves extending from the main body.

* * * * *